US012297594B2

(12) United States Patent
Kusudo et al.

(10) Patent No.: US 12,297,594 B2
(45) Date of Patent: May 13, 2025

(54) DOUBLE ROPE STRUCTURE

(71) Applicant: KURARAY CO., LTD., Kurashiki (JP)

(72) Inventors: Kazumasa Kusudo, Okayama (JP); Satoshi Katsuya, Okayama (JP); Yoshifumi Aso, Okayama (JP); Shuhei Yorimitsu, Osaka (JP)

(73) Assignee: KURARAY CO., LTD., Kurashiki (JP)

( * ) Notice: Subject to any disclaimer, the term of this patent is extended or adjusted under 35 U.S.C. 154(b) by 0 days.

(21) Appl. No.: 18/212,929

(22) Filed: Jun. 22, 2023

(65) Prior Publication Data

US 2023/0332350 A1 Oct. 19, 2023

Related U.S. Application Data

(63) Continuation of application No. PCT/JP2021/046486, filed on Dec. 16, 2021.

(30) Foreign Application Priority Data

Dec. 25, 2020 (JP) ..... 2020-217505

(51) Int. Cl.
*D07B 1/02* (2006.01)
*D04C 1/12* (2006.01)

(52) U.S. Cl.
CPC ..... *D07B 1/025* (2013.01); *D04C 1/12* (2013.01); *D07B 2201/102* (2013.01);
(Continued)

(58) Field of Classification Search
CPC .... D07B 1/02; D07B 1/025; D07B 2201/102; D07B 2201/1096; D07B 2201/2041;
(Continued)

(56) References Cited

U.S. PATENT DOCUMENTS 9,045,856 B2 6/2015 Hachisuka et al.
9,163,341 B2 10/2015 Nelis et al.
(Continued)

FOREIGN PATENT DOCUMENTS

GB 2052580 A 1/1981
JP 03053597 U 5/1991
(Continued)

OTHER PUBLICATIONS

International Search Report issued Feb. 15, 2022 in PCT/JP2021/046486 (with English translation), 4 pages.
(Continued)

*Primary Examiner* — Shaun R Hurley
(74) *Attorney, Agent, or Firm* — Element IP, PLC

(57) ABSTRACT

Provided is a double rope structure which is provided with an inner core and an outer cover. In the double rope structure, the inner core includes high strength and high modulus fibers with a yarn tenacity of 20 cN/dtex or higher and a yarn elastic modulus of 400 cN/dtex or higher, and has a ratio of yarn length/rope length of 1.005 or more and 1.200 or less, the rope length being determined as a length of a cut section (V) cut to a certain length from the rope structure, and the yarn length being determined as an average value of lengths of yarns constituting the inner core of the cut section (V).

11 Claims, 3 Drawing Sheets

(52) U.S. Cl.
CPC ..... *D07B 2201/1096* (2013.01); *D07B 2201/2041* (2013.01); *D07B 2201/2068* (2013.01); *D07B 2205/201* (2013.01); *D07B 2205/2042* (2013.01); *D07B 2205/205* (2013.01); *D07B 2401/2055* (2013.01)

(58) Field of Classification Search
CPC ..... D07B 2201/2068; D07B 2205/201; D07B 2205/2042; D07B 2205/205; D07B 2401/2055; D04C 1/12
See application file for complete search history.

(56) References Cited

U.S. PATENT DOCUMENTS

| | | | |
|---|---|---|---|
| 11,377,763 | B2 | 7/2022 | Kusudo et al. |
| 2013/0055696 | A1 | 3/2013 | Hachisuka et al. |
| 2013/0205979 | A1 | 8/2013 | Nelis et al. |
| 2020/0277715 | A1 | 9/2020 | Kusudo et al. |
| 2022/0325452 | A1 | 10/2022 | Kusudo et al. |

FOREIGN PATENT DOCUMENTS

| | | | | |
|---|---|---|---|---|
| JP | 03124888 | A | 5/1991 | |
| JP | 07165164 | A | 6/1995 | |
| JP | H08-284075 | A | 10/1996 | |
| JP | H10-317289 | A | 12/1998 | |
| JP | H11-293574 | A | 10/1999 | |
| JP | 3480865 | B2 * | 12/2003 | ..... D07B 1/18 |
| JP | 2012007255 | A | 1/2012 | |
| JP | 2013530314 | A | 7/2013 | |
| JP | 3199266 | U | 8/2015 | |
| JP | 2019183361 | A | 10/2019 | |
| KR | 10-1437321 | B1 | 9/2014 | |
| WO | WO-2011135082 | A1 | 11/2011 | |
| WO | WO-2011145224 | A1 | 11/2011 | |
| WO | WO-2019069817 | A1 | 4/2019 | |

OTHER PUBLICATIONS

International Preliminary Report on Patentability and Written Opinion issued Feb. 15, 2022 in PCT/JP2021/046486 (with English translation), 10 pages.
Extended European Search Report issued Feb. 13, 2024 in European Patent Application No. 21910583.0, 9 pages.
Argument against Notice of Reasons for Revocation, filed Jun. 10, 2024 (Opposition No. 2023-700995-03) (with English machine translation), 42 pages.
Argument against Notice of Reasons for Revocation, filed Jun. 3, 2024 (Opposition No. 2023-700995-01) (with English machine translation), 11 pages.
Argument against Notice of Reasons for Revocation, filed Jun. 5, 2024 (Opposition No. 2023-700995-02) (with English machine translation), 47 pages.
Atushi Horigome, et al., "Basic Study of Drive Mechanism with Synthetic Fiber Rope-Investigation of Strength Reduction by Bending and Terminal Fixation Method", Advanced Robotics, vol. 30, No. 3, 2016, p. 206-220.
Catalogue of "Ace Line®D", Tokyo Seiko Rope MFG.CO., LTD., 2006, 9 pages.
Catalogue of "Ace Line®T", Tokyo Seiko Rope MFG.CO., LTD., May 2007, 8 pages.
Catalogue of "Ace Line®V", Tokyo Seiko Rope MFG.CO., LTD., May 2007, 6 pages.
Catalogue of "Naroc Final Cline", Naroc Kabushiki Kaisha, retrieved by application on Oct. 20, 2023, 2 pages.
Catalogue of "Naroc Final Cline", Naroc Kabushiki Kaisha, retrieved by application on Jun. 28, 2024, 2 pages.
Catalogue of "Naroc Final Cline", Naroc Kabushiki Kaisha(NAFC-7), retrieved by application on Jun. 28, 2024, 2 pages.
Certificate of Experiment Results, Naroc Kabushikikaisha, 2023, 36 pages.
Certificate of Experiment Results, Teijin Limited, Aug. 9, 2023, 3 pages.
General Catalog of Tokyo Seiko Rope Mfg. Co., Ltd., Apr. 2020, 32 pages.
Handbook of testile properties of textile and technical fibres, Woodhead Publishing Limited, 2009, 6 pages.
In-house Proposal of New Catalogs, Naroc Kabushikikaisha, 2022, 1 page.
Material proving the saved date of the web pages of Product Introduction posting the front page of C2-Catalogue of "Ace Line®T", Tokyo Seiko Rope MFG.CO., LTD., Sep. 2023, 1 page.
Material proving the saved date of the web page posting C2-Catalogue of "Ace Line®T", Tokyo Seiko Rope MFG.CO., LTD., Sep. 2023, 2 pages.
Notice of Reasons for Revocation issued Feb. 9, 2024, in corresponding Japanese Patent Application No. 2022-552698 (with English machine translation), 38 pages.
Notice of Reasons for Revocation issued on Oct. 21, 2024, in corresponding Japanese Patent Application No. 2022-552698 (with English machine translation), 50 pages.
Photos showing product label of rope, shipping label of rope, rolled rope and rope wrapped for shipping, all of which were received by Teijin Limited, Feb. 2016, 2 pages.
Shipping certificate, Tokyo Seiko Rope Mfg. Co., Ltd., 2016, 1 page.
"The Specific Character and the Use of Polyallylate Fiber", Seni Gakkaishi, vol. 66, No. 3, 2010 (with English machine translation), 10 pages.
Written Opposition filed on Sep. 20, 2023 (Opposition No. 2023-700995-01) (with English machine translation), 90 pages.
Written Opposition filed on Sep. 29, 2023 (Opposition No. 2023-700995-03) (with English machine translation), 115 pages.
Written Opposition filed Sep. 14, 2023 (Opposition No. 2023-700995-02) (with English machine translation), 50 pages.

* cited by examiner

DOUBLE ROPE STRUCTURE

CROSS REFERENCE TO THE RELATED APPLICATIONS

This application is a continuation application, under 35 U.S.C. § 111(a), of international application No. PCT/JP2021/046486 filed Dec. 16, 2021, which claims priority to Japanese application No. 2020-217505, filed Dec. 25, 2020, the entire disclosures of all of which are herein incorporated by reference as a part of this application.

FIELD OF THE INVENTION

The present invention relates to a double rope structure which comprises an inner core and an outer cover.

BACKGROUND ART

Ropes are produced from a plurality of strands by twisting or braiding them to obtain structures of cords or strings, and used for applications in water such as mooring ropes for vessels and fishing nets, and applications on land such as traction ropes and load ropes. A strand comprises two or more yarns, and a yarn comprises two or more single fibers as raw materials.

The rope structures include rope structures with double structure, in addition to rope structures with single structure. The double rope structure is formed from an inner core and an outer cover, in which the inner core and the outer cover are each formed from strands, either twisted or braided. For example, Patent document 1 (Japanese Utility Model Gazette No. 3199266) discloses a fiber rope having a double structure which comprises a core material and an outer cover rope covering the outside of the core material, wherein the core material is made of high strength and high modulus fibers, and the outer cover rope is a braided rope formed from mixed yarns of high strength and high modulus fibers and general-purpose fibers, in which the proportion of the high strength and high modulus fibers is higher than that of the general-purpose fibers.

RELATED ART DOCUMENT

Patent Document

[Patent Document 1] Japanese Utility Model Gazette No. 3199266

SUMMARY OF THE INVENTION

However, although Patent Document 1 describes twisting two or more strands consisting of high strength and high modulus fibers as the core material, Patent Document 1 is silent on structure of yarns constituting the strands. Accordingly, there is no technical indication in Patent Document 1 to improve rope strength by adjusting yarns constituting the rope structure.

Accordingly, an object of the present invention is to provide a double rope structure which is excellent in strength and bending durability.

As a result of intensive studies conducted by the inventors of the present invention in an attempt to solve the problem of the conventional technology, it has been found that use of high strength and high modulus fibers as an inner core in a double rope structure can improve strength of the rope structure thanks to the tenacity property of the high strength and high modulus fibers. On the other hand, the inventors have also found that even if high strength and high modulus fibers were used as an inner core, the double rope structure did not always have improved strength. As a result of the further investigation, the inventors have been found that by adjusting length of yarns which constitute the high strength and high modulus fibers used as an inner core at a specific ratio based on the length of the rope, the obtained rope structure can not only effectively make use of the original tenacity of the high strength and high modulus fibers, but also have improved bending durability, and thus the inventors finally completed the invention.

That is, the present invention may include the following aspects.

Aspect 1

A double rope structure comprising an inner core and an outer cover, wherein the inner core comprises high strength and high modulus fibers with a yarn tenacity of 20 cN/dtex or higher (preferably 22 cN/dtex or higher) and a yarn elastic modulus of 400 cN/dtex or higher (preferably 450 cN/dtex or higher), and has a ratio of yarn length/rope length of 1.005 or more and 1.200 or less (preferably from 1.006 to 1.180, more preferably from 1.007 to 1.150, particularly preferably from 1.007 to 1.130), the rope length being determined as a length of a cut section cut to a certain length from the rope structure, and the yarn length being determined as an average value of lengths of yarns constituting the inner core of the cut section.

Aspect 2

The double rope structure according to aspect 1, wherein the outer cover substantially comprises non-high strength and non-high modulus fibers.

Aspect 3

The double rope structure according to aspect 1 or 2, wherein strands which constitute the inner core have a crossing angle of 40° or less (preferably 35° or less, more preferably 33° or less, still more preferably 300 or less, in particular preferably 27° or less) relative to a longitudinal direction of the rope.

Aspect 4

The double rope structure according to aspect 3, wherein the yarns in the inner core have twists of from 150 to 0.1 T/m (preferably from 100 to 2 T/m, more preferably from 80 to 3 T/m, further more preferably from 60 to 6 T/m).

Aspect 5

The double rope structure according to any one of aspects 1 to 4, wherein the high strength and high modulus fibers have a yarn elongation of from 3 to 6% (preferably from 3.5 to 5.5%).

Aspect 6

The double rope structure according to any one of aspects 1 to 5, wherein the high strength and high modulus fibers are at least one selected from the group consisting of liquid crystal polyester fibers, ultra-high molecular weight polyethylene fibers, aramid fibers, and poly(para-phenylene benzobisoxazole) fibers.

Aspect 7

The double rope structure according to any one of aspects 1 to 6, wherein the double rope structure satisfies a strength utilization degree of 40% or more (preferably 50% or more, more preferably 55% or more, and still more preferably 60% or more), the strength utilization degree being a percentage of tensile strength of the double rope structure based on a value obtained by multiplying yarn tenacity of strands constituting the inner core by the number of all strands in the inner core.

Aspect 8

The double rope structure according to any one of aspects 1 to 7, wherein the double rope structure has a tenacity retention of 45% or more (preferably 50% or more, and more preferably 55% or more) comparing before and after bending test, in which the double rope structure is subjected to repeated bending of 300,000 times at a bending angle of 240° with a bending R of 7.5 mm.

Aspect 9

The double rope structure according to any one of aspects 1 to 8, wherein the double rope structure has a tenacity retention of 45% or more (preferably 60% or more, and more preferably 80% or more) at a temperature of 80° C.

Aspect 10

The double rope structure according to any one of aspects 1 to 9, wherein both the inner core and the outer cover are braided bodies.

Aspect 11

The double rope structure according to any one of aspects 1 to 10, wherein the inner core accounts for 40 wt % or more of the double rope structure.

The present invention encompasses any combination of at least two features disclosed in the claims and/or the specification and/or the drawings. In particular, any combination of two or more of the appended claims should be equally construed as included within the scope of the present invention.

According to the present invention, since the double rope structure comprises an inner core comprising yarns of high strength and high modulus fibers, with the length of the yarns of high strength and high modulus fibers adjusted in a specific range relative to the length of the rope, and the inner core covered with an outer cover, the rope structure can realize both improved strength and bending durability.

BRIEF DESCRIPTION OF THE DRAWINGS

In any event, the present invention will be more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. The drawings are not necessarily shown at a consistent scale and are exaggerated in order to illustrate the principle of the present invention.

DETAILED DESCRIPTION OF THE INVENTION

Figure 1:
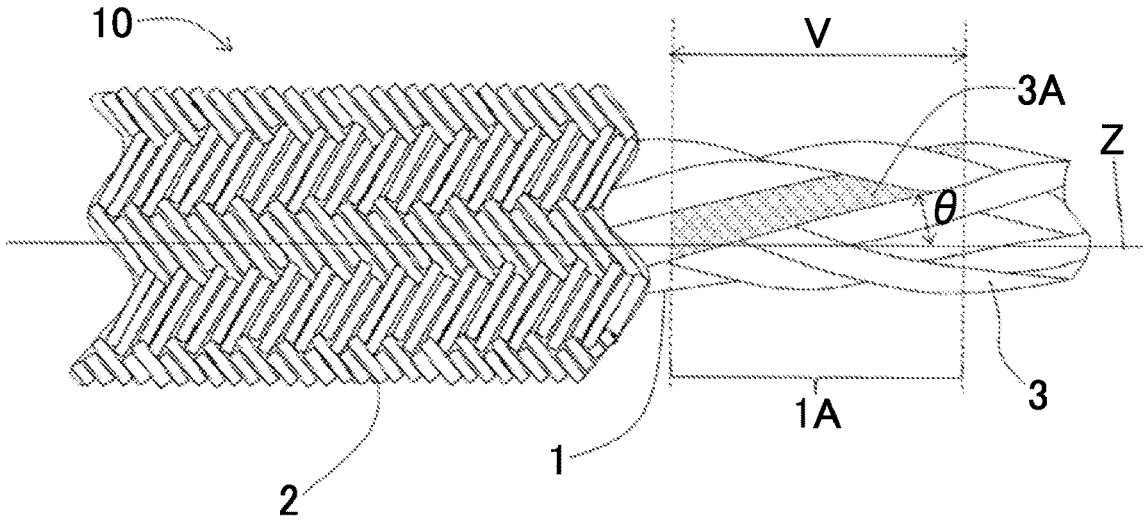
FIG. 1 is an exploded schematic side view of the double rope structure according to one embodiment of the present invention.
Figure 2:
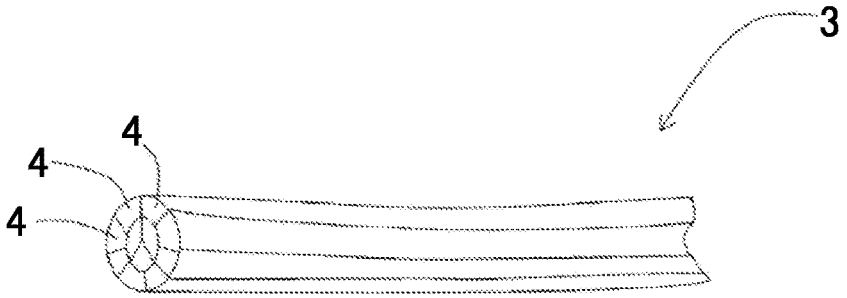
FIG. 2 is a schematic perspective view showing a strand which forms the inner core of the double rope structure of FIG. 1 in a partially enlarged manner.

Hereinafter, the present invention is explained in more detail based on exemplification. FIG. 1 is an exploded schematic side view of the double rope structure according to one embodiment of the present invention, and FIG. 2 is a schematic perspective view which shows a strand 3 which forms the inner core of the double rope structure of FIG. 1 in a partially enlarged manner. As shown in FIG. 1, a double rope structure 10 comprises an inner core 1 and an outer cover 2 covering the inner core. In FIG. 1, in order to show the state of the inner core 1, a part of the outer cover 2 is omitted.

Both the inner core 1 and the outer cover 2 have braided structures in which a plurality of strands are braided. Each strand comprises a plurality of yarns, and each yarn comprises a plurality of single fibers. For example, the strand 3 constituting the inner core 1 of the double rope structure 10 of FIG. 1 comprises a plurality of yarns 4 as shown in FIG. 2. Each yarn 4 is a twisted body of two or more raw fibers (or untwisted filaments).

FIG. 1 shows a cut section A which has a predetermined length V of the inner core 1. The cut section 1A represents an inner core portion which is cut to a predetermined length V from the double rope structure 10. The cut section 1A can be disassembled (untwisted/unbraided) into a plurality of strands which constitute the cut section 1A. In FIG. 1, one of the plurality of strands is shown as a dotted strand 3A. The strand 3A comprises a plurality of yarns (not shown).

Figure 3:
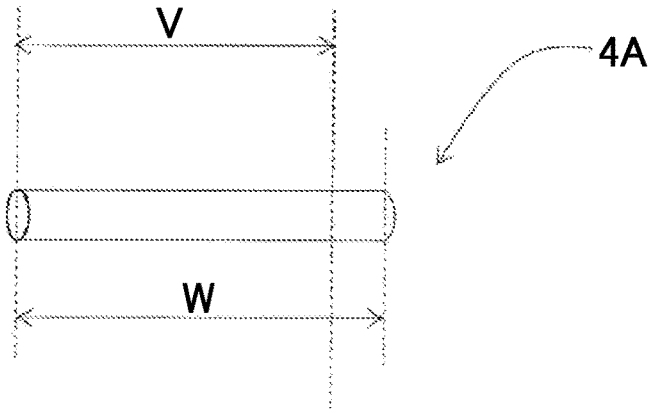
FIG. 3 is a schematic perspective view for explaining the relationship between the length of one yarn and the length of a cut section, the yarn being one of the yarns constituting a strand in the cut section of the double rope structure.

FIG. 3 is a schematic perspective view for explaining the relationship between length W of one yarn 4A and length of the cut section 1A, the yarn 4A being one of the yarns constituting the strand 3A in the cut section 1A. The double rope structure 10 is cut to a predetermined length V to give the cut section 1A which contains the strand 3A. Then, the strand 3A is disassembled into yarns 4A to measure a length W of a yarn 4A.

According to the double rope structure of the present invention, from a viewpoint of enhancing the both tenacity and bending durability of the double rope structure by using high strength and high modulus fibers constituting the inner core 1, the strand 3A in the cut section 1A comprises yarns 4A with a length W, and a ratio (W/V) of the length W of the yarns relative to the length V of the cut section is within a range of 1.005 or more and 1.200 or less.

In the double rope structure 10, the inner core 1 is formed by strands which are constituted by yarns having a length as close as possible to the length of the rope itself, so that the tenacity of yarns of high strength and high modulus fibers can be efficiently utilized. On the other hand, where the length of the yarns constituting strands is too close to the length of the rope itself, it is difficult not only to form strands into a twisted body or a braided body, but also to improve bending durability because of unstable configuration of the double rope structure.

Preferably, strands cross the longitudinal direction Z passing through the center of the double rope structure (hereafter, simply referred to as the rope longitudinal direction Z) at a smallest possible crossing angle relative to the rope longitudinal direction Z. For example, as shown in FIG. 1, the strand 3A constituting the inner core crosses the rope longitudinal direction Z at a crossing angle θ ($0° < \theta < 90°$) relative to the rope longitudinal direction Z. The crossing angle θ can be measured using a photo image of the side of the fibers which is taken with the outer cover 1 removed to expose the inner core 2. For example, in FIG. 1, a strand 3A which crosses the rope longitudinal direction Z of the double rope structure 10 is randomly selected, and a side of the strand 3A which is close to the rope longitudinal direction Z crosses the rope longitudinal direction Z at an angle θ relative to the rope longitudinal direction Z. Here the angle θ is referred to as the crossing angle.

Figure 4:
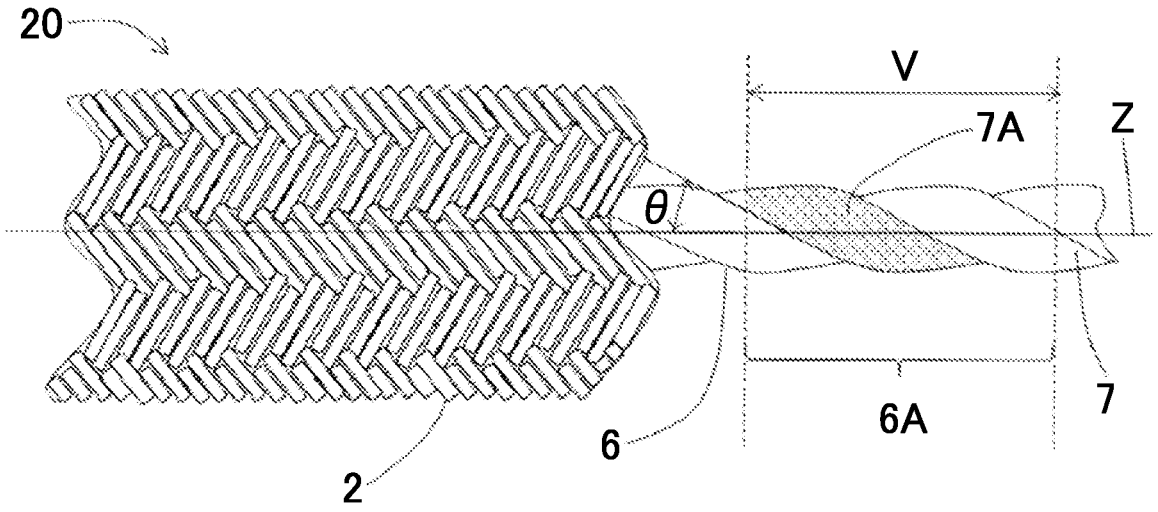
FIG. 4 is an exploded schematic side view of the double rope structure according to another embodiment of the present invention.

FIG. 4 is an exploded schematic side view of the double rope structure according to another embodiment of the present invention. The double rope structure 20 comprises an inner core 6 and an outer cover 2 which covers the inner cover 6. The outer cover 2 is a braided body and is unified with the inner core 6 to constitute the double rope structure. The same constituting elements as those in FIG. 1 are denoted with the same reference signs, and the description thereof will be omitted.

The inner core 6 has a twisted structure in which a plurality of strands 7 are twisted. Each strand comprises a plurality of yarns, and each yarn comprises a plurality of single fibers. For example, the strand 7 constituting the inner core 6 of the double rope structure 20 of FIG. 4 comprises a plurality of yarns 4 likewise the strand 3 shown in FIG. 2, and each yarn 4 is a twisted body of two or more raw fibers.

FIG. 4 shows a cut section 6A which has a predetermined length V in the inner core 6. The cut section 6A represents an inner core portion which is cut to a predetermined length V from the double rope structure 20. The cut section 6A can be disassembled into a plurality of strands which constitute the cut section 6A. In FIG. 4, one of the plurality of strands is shown as a dotted strand 7A. The strand 7A comprises a plurality of yarns (not shown). The ratio (W/V) of the length W of the yarns constituting the strand 7A relative to the length V of the cut section 6A is within a range of 1.005 or more and 1.200 or less.

As shown in FIG. 4, the strand 7A constituting the inner core crosses the rope longitudinal direction Z at a crossing angle θ ($0°<\theta<90°$) relative to the rope longitudinal direction Z. For example, in FIG. 4, a strand 7A which crosses the rope longitudinal direction Z of the double rope structure 20 is randomly selected, and a side of the strand 7A which is close to the rope longitudinal direction Z crosses the rope longitudinal direction Z at an angle θ as the crossing angle.

As shown in FIG. 1 and FIG. 4, the outer cover 2 is formed by the braided body of the strands. As shown in FIG. 2, each of the strand comprises a plurality of yarns.

Hereinafter, a desirable embodiment of the double rope structure according to the present invention is described.

Inner Core

The inner core of the double rope structure according to the present invention satisfies a ratio of yarn length/rope length (W/V) in a range of from 1.005 to 1.200, preferably from 1.006 to 1.180, more preferably from 1.007 to 1.150, particularly preferably from 1.007 to 1.130, in which the ratio is calculated by dividing the average yarn length of the yarns constituting the inner core of the cut section by the rope length of the cut section cut to 1 m (correctly 1.000 m) in length. Here, the yarn length and rope length are values measured by the method described in Examples below. In the above-mentioned range, it is possible to improve the tensile tenacity of the double rope structure as well as to maintain high tenacity retention after bending the rope structure.

As long as the inner core of the double rope structure of the present invention satisfies the ratio of yarn length/rope length (W/V) in the predetermined range, the inner core of the double rope structure of the present invention may be a twisted body, or a braided body. Twisted bodies may usually have 3 strands or 4 strands, while braided bodies may have 8 strands, 12 strands, 16 strands, 32 strands, etc. Among them, braided bodies may be preferably used. In particular, preferable ones may include braided bodies with 8 strands, 12 strands, or 16 strands, especially preferably braided bodies with 12 strands, or 16 strands. The braided bodies may be either round or square. Preferably, the braided bodies may be round from the viewpoint of abrasion resistance.

In doubling and twisting or braiding, the strand may have a pitch (number of yarns/inch) adjusted, for example, in the range of from 2.5 to 20, preferably from 3 to 18, and more preferably from 3.3 to 15. The pitch denotes the number of yarns constituting the strand per inch along the longitudinal direction in a rope. For example, the pitch can be measured and confirmed using a digital microscope VHX-2000 available from KEYENCE CORP.

In doubling and twisting or braiding, the strand may have a lead (mm/yarns) adjusted, for example, in the range of from 18 to 100, preferably from 20 to 90, and more preferably from 23 to 85. Here, the lead denotes a length required for a strand to make one complete helical convolution in a rope.

In doubling and twisting or braiding, the strand may have a ratio of lead/diameter (/yarn) adjusted, for example, in a range of 8 to 70, preferably 9 to 60, and more preferably 10 to 50. Here, the lead/diameter denotes a ratio of the lead to the diameter of the inner core.

The strand may cross the rope longitudinal direction at a smallest possible crossing angle, and the crossing angle θ may be 40° or less. The crossing angle θ at which the strand constituting the inner core crosses the rope longitudinal direction may be preferably 35° or less, more preferably 33° or less, still more preferably 30° or less, and particularly preferably 27° or less. The lower limit of the crossing angle may be, for example, 2° or more, preferably 3° or more, and more preferably 6° or more.

With respect to a plurality of yarns which constitutes a strand, the number of twists of each yarn may be from 150 to 0.1 T/m, preferably from 100 to 2 T/m, more preferably from 80 to 3 T/m, further preferably from 70 to 5 T/m, and particularly preferably 60 to 6 T/m. Although a smaller number of twists can enhance the strength of a rope, untwisted yarns may have deteriorated handleability for forming a strand. Here, 0.1 T/m is equivalent to 1 T/10 m. As for a plurality of strands constituting an inner core, the strand may be twisted, if necessary, in a range that satisfies the specific yarn length/rope length specified in the present invention. A plurality of strands may further be twisted, if necessary, in a range that satisfies the specific yarn length/rope length specified in the present invention.

The fineness of yarn can be suitably determined depending on the desirable fineness of the double rope structure, or the like. For example, the yarn may have a fineness of 30 dtex or more, preferably 200 dtex or more, and more preferably 400 dtex or more. The yarn fineness may be 6000 dtex or less, preferably 5000 dtex or less, more preferably 4000 dtex or less, and still more preferably 2500 dtex or less.

The diameter of the inner core can be suitably determined depending on the intended use, and may be, for example, from 0.5 to 100 mm, preferably from 1.5 to 80 mm, and more preferably from 2 to 60 mm. The diameter of the inner core can be measured using electronic slide calipers, at a fiber section cut in a direction perpendicular to the rope longitudinal direction after embedding the double rope structure by resin.

From a viewpoint of using the tenacity of high strength and high modulus fibers, the proportion of the inner core in the double rope structure may be, for example, from 40 to 90 wt %, preferably from 50 to 80 wt %, and still more preferably from 60 to 75 wt %.

The high strength and high modulus fibers which constitute the inner core may be any one which can achieve a yarn tenacity of 20 cN/dtex or more and a yarn elastic modulus of 400 cN/dtex or more, and such high strength and high modulus fibers may be exemplified as liquid crystalline polyester fibers such as Vectran (trademark), Siveras (trademark), Zxion (trademark), etc.; ultra-high molecular weight polyethylene fibers such as Isanas (trademark), Dyneema (trademark), etc.; aramid fibers such as Kevlar (trademark), Twaron (trademark), Technora (trademark), etc.; poly(paraphenylene benzobisoxazole) fibers such as Zylon (trademark), etc.; and other fibers with high strength and high modulus of elasticity. Among them, liquid crystalline polyester fibers and ultra-high molecular weight polyethylene fibers are preferred from the viewpoint of superior abrasion resistance. Liquid crystalline polyester fibers and aramid fibers are preferred from the viewpoint of superior heat resistance. Liquid crystalline polyester fibers are preferred from the viewpoint of superior heat resistance and abrasion resistance.

Liquid crystal polyester fibers can be produced, for example, by melt-spinning a liquid crystalline polyester to obtain as-spun fibers, and subjecting the as-spun fibers to solid phase polymerization. Two or more liquid crystal polyester monofilaments are gathered to obtain a liquid crystalline polyester multifilament.

Liquid crystalline polyester is a polyester capable of forming an optically anisotropic melt phase (liquid crystallinity), and can be recognized, for example, by placing a sample on a hot stage to heat under a nitrogen atmosphere and observing penetration light through the sample using a polarization microscope.

The liquid crystal polyester comprises repeating structural units originating from, for example, aromatic diols, aromatic dicarboxylic acids, aromatic hydroxycarboxylic acids, etc. As long as the effect of the present invention is not spoiled, the repeating structural units are not limited to a specific chemical composition. The liquid crystal polyester may include the structural units originating from aromatic diamines, aromatic hydroxy amines, or aromatic aminocarboxylic acids in the range which does not spoil the effect of the present invention.

For example, the preferable structural units may include units shown in Table 1.

TABLE 1

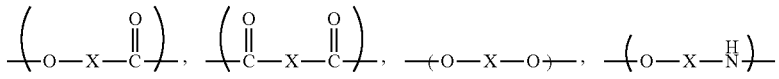

In the formula, X is selected from the following

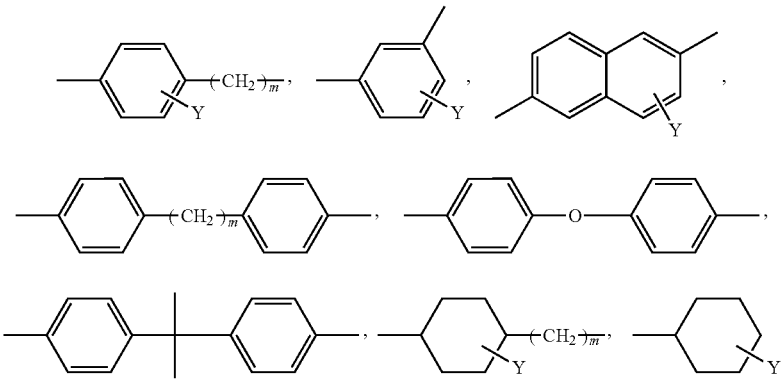

m is an integer from 0 to 2, Y is a substituent selected from hydrogen atom, halogen atoms, aryl groups, aralkyl groups, alkoxy groups, aryloxy groups, aralkyloxy groups.

Y independently represents, as from one substituent to the number of substituents in the range of the replaceable maximum number of aromatic ring, can be selected from the group consisting of a hydrogen atom, a halogen atom (for example, fluorine atom, chlorine atom, bromine atom and iodine atom), an alkyl group (for example, an alkyl group having 1 to 4 carbon atoms such as methyl group, ethyl group, isopropyl group and t-butyl group), an alkoxy group (for example, methoxy group, ethoxy group, isopropoxy group, n-butoxy group, etc.), an aryl group (for example, phenyl group, naphthyl group, etc.), an aralkyl group [benzyl group (phenylmethyl group), phenethyl group (phenylethyl group)], an aryloxy group (for example, phenoxy group etc.), an aralkyloxy group (for example, benzyloxy group etc.), and others.

As more preferable structural units, there may be mentioned structural units as described in Examples (1) to (18) shown in the following Tables 2, 3, and 4. It should be noted that where the structural unit in the formula is a structural unit which can show a plurality of structures, combination of two or more units may be used as structural units for a polymer.

TABLE 2
(1)
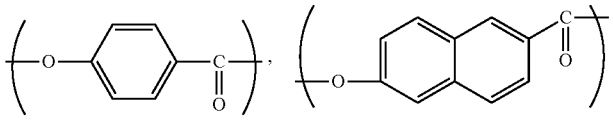
(2)
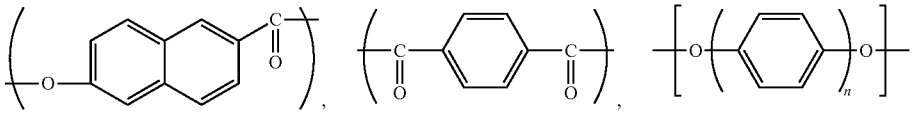
(3)
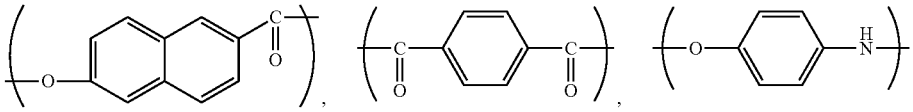
(4)
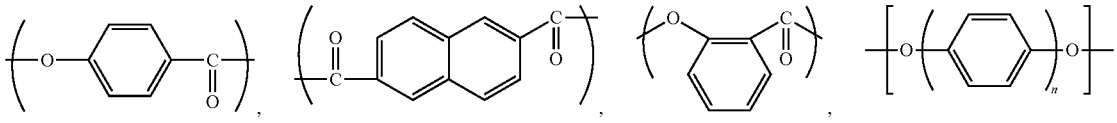
(5)
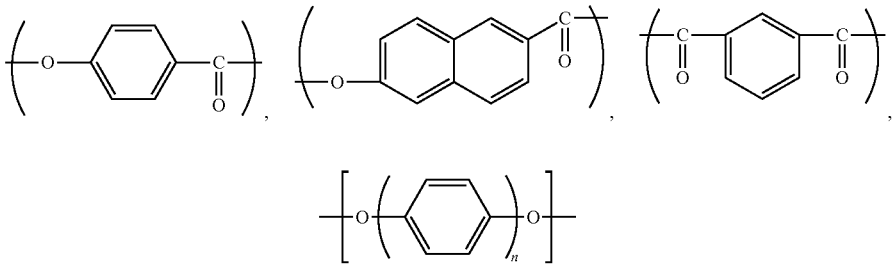
(6)
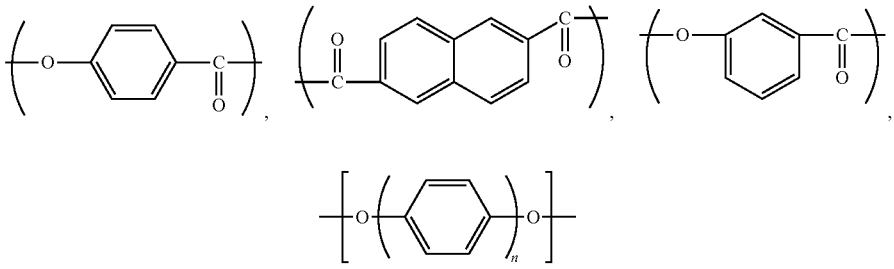
(7)
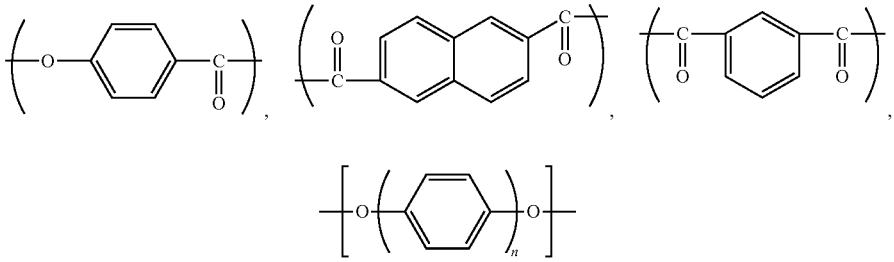
(8)
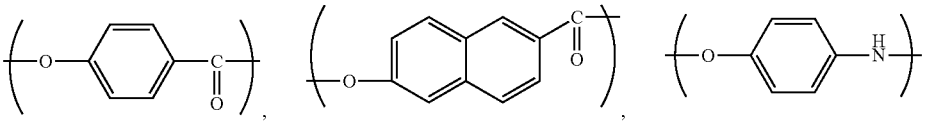

TABLE 2-continued
| |
|---|
| 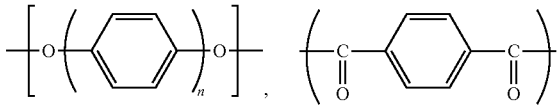 |
TABLE 3
| | |
|---|---|
| (9) | 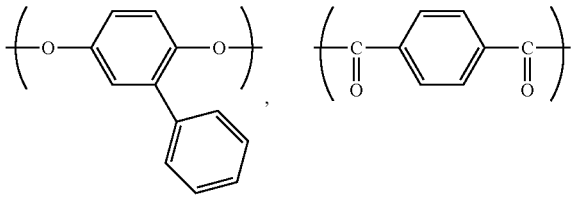 |
| (10) | 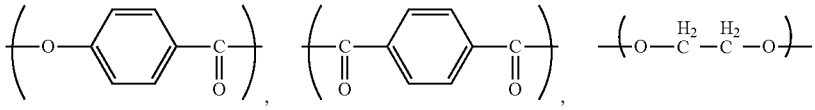 |
| (11) | 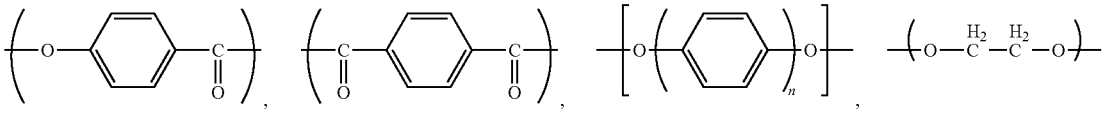 |
| (12) | 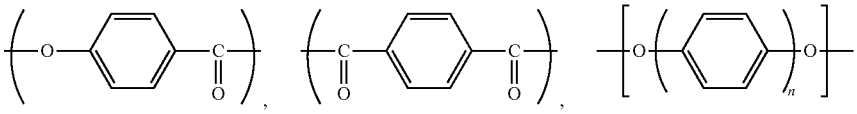 |
| (13) | 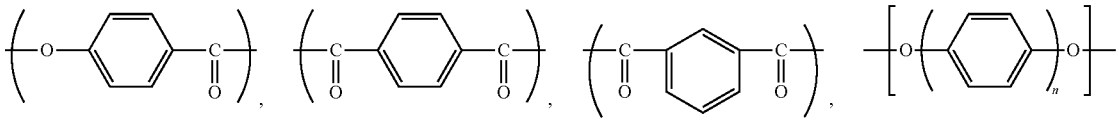 |
| (14) | 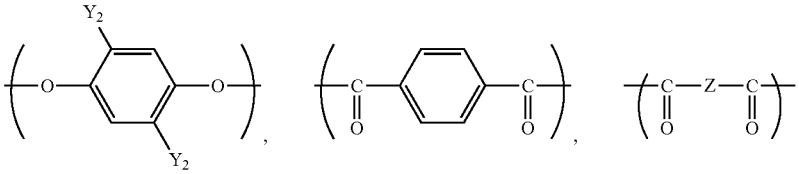 |
| (15) | 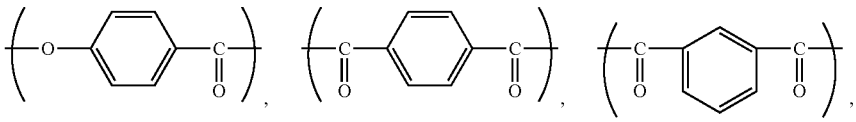 |
| | 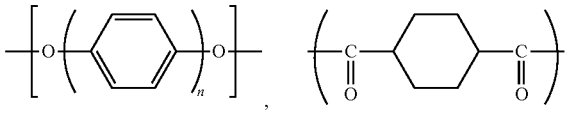 |

TABLE 4

(16)

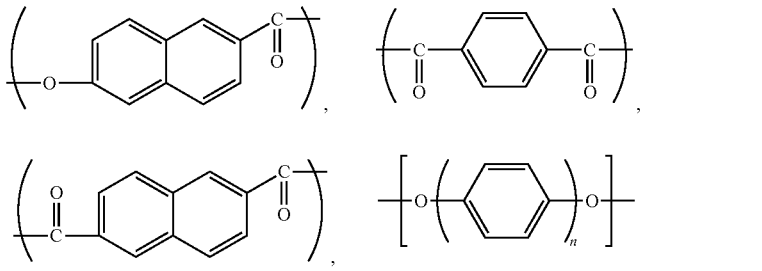

(17)

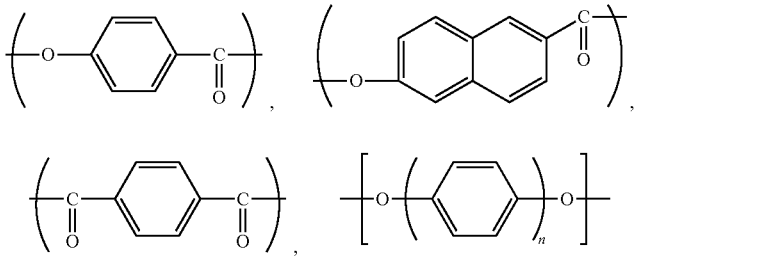

(18)

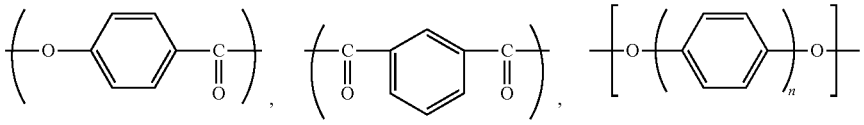

In the structural units shown in Tables 2, 3, and 4, n is an integer of 1 or 2, in each of the structural units, n=1 and n=2 may independently exist, or may exist in combination; each of the Y1 and Y2 independently represents, hydrogen atom, a halogen atom, (for example, fluorine atom, chlorine atom, bromine atom, iodine atom, etc.), an alkyl group (for example, an alkyl group having 1 to 4 carbon atoms such as methyl group, ethyl group, isopropyl group, and t-butyl group, etc.), an alkoxy group (for example, methoxy group, ethoxy group, isopropoxy group, n-butoxy group, etc.), an aryl group (for example, phenyl group, naphthyl group, etc.), an aralkyl group [benzyl group (phenylmethyl group), phenethyl group (phenylethyl group), etc.], an aryloxy group (for example, phenoxy group etc.), an aralkyloxy group (for example, benzyloxy group etc.), and others. Among these, the preferable Y1 and Y2 may include hydrogen atom, chlorine atom, bromine atom, and methyl group.

Z may include substituents denoted by following formulae.

Chem. 1

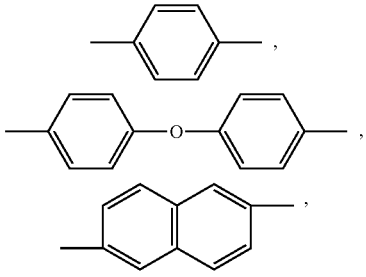

-continued

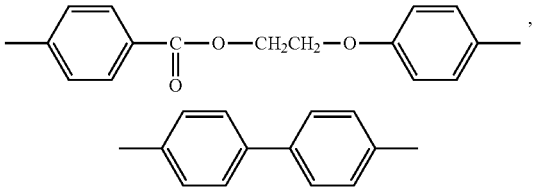

Preferable liquid crystal polyesters may comprise a combination of two or more structural units having a naphthalene skeleton. Especially preferable one may include both the structural unit (A) derived from hydroxybenzoic acid and the structural unit (B) derived from hydroxy naphthoic acid. For example, the structural unit (A) may have a following formula (A), and the structural unit (B) may have a following formula (B). From the viewpoint of ease of enhancing melt-spinnability, the ratio of the structural unit (A) and the structural unit (B) may be in a range of former/latter of from 9/1 to 1/1, more preferably from 7/1 to 1/1, still preferably from 5/1 to 1/1.

Chem. 2

(A)

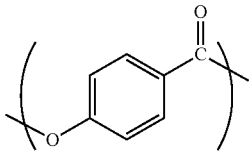

-continued

Chem. 3

(B)

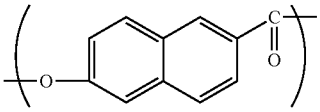

The total proportion of the structural units of (A) and (B) may be, based on all the structural units, for example, greater than or equal to 65 mol %, more preferably greater than or equal to 70 mol %, and still more preferably greater than or equal to 80 mol %. Especially referred liquid crystal polyesters have the structural unit (B) at a proportion of from 4 to 45 mol % in the polymers.

The liquid crystal polyester suitably used in the present invention preferably has a melting point in the range from 250 to 360° C., and more preferably from 260 to 320° C. The melting point here means a temperature at which a main absorption peak is observed in measurement in accordance with JIS K7121 examining method using a differential scanning calorimeter (DSC: "TA3000" produced by Mettler). More concretely, after taking 10 to 20 mg of a sample into the above-mentioned DSC apparatus to enclose the sample in an aluminum pan, the sample is heated at a heating rate of 20° C./minute with nitrogen as carrier gas introduced at a flow rate of 100 cc/minute to measure the position of an appearing endothermic peak. Depending on the type of polymer, where a clear peak does not appear in the first run in the DSC measurement, the sample is heated to a temperature higher by 50° C. than the expected flow temperature at a heating rate of 50° C./minute and is kept at the temperature for 3 minutes to be completely molten, and the melt is quenched to 50° C. at a rate of −80° C./minute. Subsequently, the quenched material is reheated at a heating rate of 20° C./minute, and the position of an appearing endothermic peak may be recorded.

The liquid crystal polyester may further comprise a thermoplastic polymer such as a polyethylene terephthalate, a modified polyethylene terephthalate, a polyolefin, a polycarbonate, a polyamide, a polyphenylene sulfide, a polyetheretherketone, and a fluororesin to the extent that the effect of the invention is not spoiled. In addition, various additives such as inorganic materials such as titanium dioxide, kaolin, silica, and barium oxide; coloring agents such as a carbon black, a dye, and a pigment; an antioxidant, a UV absorber, and a light stabilizer may also be added.

The high strength and high modulus fiber may have a yarn tenacity of 20 cN/dtex or more, and preferably 22 cN/dtex or more. Although the upper limit is not particularly limited, it may be, for example, 40 cN/dtex.

The high strength and high modulus fiber may have a yarn elastic modulus of 400 cN/dtex or more, and preferably 450 cN/dtex or more. Although the upper limit is not particularly limited, it may be, for example, 600 cN/dtex.

The high strength and high modulus fiber may have a yarn elongation of, for example, from 3 to 6%, and preferably from 3.5 to 5.5%.

The yarn tenacity, the yarn elastic modulus, and the yarn elongation are values measured by the method described in Examples below.

Outer Cover

According to the double rope structure of the present invention, an outer cover comprises a twisted-covering body comprising strands to cover an inner core or a braided body comprising strands to cover an inner core. The twisted-covering body can be formed by twisting strands helically around the inner core. The braided body can be formed by braiding to cover the inner core as a core with 8 strands, 12 strands, 16 strands, 24 strands, 32 strands, 40 strands, 48 strands, 64 strands or others. Among them, preferable one may include braided bodies with 16 strands, 24 strands, 32 strands, 40 strands, or 48 strands; more preferably braided bodies with 24 strands, 32 strands, or 40 strands.

The strands constituting the outer cover may be formed from the high strength and high modulus fibers, or non-high strength and non-high modulus fibers (hereinafter, simply referred to as non-high strength-high modulus fibers).

The non-high strength-high modulus fiber may have a yarn tenacity of less than 20 cN/dtex, and usually, for example, about from 1 cN/dtex to 15 cN/dtex. The non-high strength-high modulus fiber may have a yarn elastic modulus of less than 400 cN/dtex, and usually, for example, about from 10 cN/dtex to 200 cN/dtex. The non-high strength-high modulus fiber may have a yarn elongation of, for example, from 3 to 20%, and preferably from 7 to 20%.

Examples of the non-high strength-high modulus fibers may include general-purpose synthetic fibers, such as general-purpose polyester fibers (e.g., polyethylene terephthalate fibers), polyolefin fibers (e.g., polyethylene fibers, polypropylene fibers), polyamide fibers (e.g., nylon 6 fibers, nylon 6,6 fibers), polyvinyl alcohol fibers (e.g., vinylon (trademark) fibers), and others.

Since the strength of the rope structure can be achieved by the inner core in the double rope structure, the outer cover may substantially comprise non-high strength-high modulus fibers. Here, the term "substantially" denotes that a proportion of the non-high strength-high modulus fibers in the outer cover is 80 wt % or more, and preferably 90 wt % or more (e.g., from 90 to 100 wt %).

The fineness of the yarn constituting strands of the outer cover can be suitably determined depending on the desired fineness of the double rope structure, or the like. The fineness of the yarn may be, for example, from 50 to 1000 dtex, preferably from 100 to 500 dtex, more preferably from 200 to 400 dtex.

Double Rope Structure

The double rope structure according to the present invention is a double rope structure which comprises an inner core and an outer cover and has a specific inner core structure, so that the double rope structure has improved strength as well as bending durability.

For example, since the double rope structure can achieve high strength thanks to the inner core, the double rope structure may have, for example, a tensile strength of over 2.0 kN, preferably 2.2 kN or more, more preferably 2.4 kN or more, and further preferably 3.0 kN or more. Although the upper limit thereof is not particularly limited to a specific value, it may be, for example, 6.0 kN. The tensile strength of the double rope structure is a value measured by the method described in Examples below.

It is desirable for the double rope structure to utilize tenacity of yarns itself as much as possible, and the double rope structure may have a strength utilization degree of, for example, 40% or more, preferably 50% or more, more preferably 55% or more, and still more preferably 60% or more. Although the upper limit thereof is not particularly limited to a specific value, it may be, for example, 100%. The strength utilization degree of the double rope structure is calculated as a percentage of a ratio of tensile strength of the double rope structure based on a value obtained by multiplying yarn tenacity of yarns constituting the inner core by the number of all strands in the inner core.

The double rope structure preferably has a higher tenacity retention comparing before and after bending test, in which the double rope structure is, for example, subjected to repeated bending of 300,000 times at a bending angle of 240° with a bending R (bending radius) of 7.5 mm. The double rope structure may have a tenacity retention of, for example, 45% or more, preferably 50% or more, and more preferably 55% or more, comparing before and after bending test. Although the upper limit thereof is not particularly limited to a specific value, it may be, for example, 100%. The tenacity retention of the double rope structure after bending test is a value measured by the method described in Examples below.

The double rope structure is excellent in abrasion resistance. When a double rope structure in a loop shape is threaded through an upper pully (inside diameter of 45 mm) and a lower pully (inside diameter of 45 mm) arranged 500 mm apart from the upper pully, with the double rope structure twisted 3 times between the pulleys, to carry out a twisting abrasion test by reciprocating the double rope structure under a load of 3 kg on the lower pully at an angle of 180° in a cycle of 60 times/minute (MV=34.2 Hz), the cycle-to-breakage of the double rope structure may be, for example, 100,000 times or more, preferably 200,000 times or more, and may exceed 550,000 times, and more preferably 600,000 times or more, still more preferably 800,000 times or more, and particularly preferably 1 million times or more. It should be noted that abrasion resistance may be determined as a maximum value in the abrasion test for 277 hours (i.e., cycle-to-breakage of 1 million times). Although the upper limit thereof is not particularly limited to a specific value, it may be, for example, 5 million times.

Preferably, double rope structures may excel in heat resistance. As an index for indicating heat resistance, such a double rope structure has a tenacity retention of, for example, 45% or more, preferably 60% or more, and more preferably 80% or more after retainment at 80° C. for 30 days. Although the upper limit thereof is not particularly limited to a specific value, it may be, for example, 100%. The heat resistance of double rope structures is a value measured by the method described in Example below.

EXAMPLES

Hereinafter, the present invention will be demonstrated by way of some examples that are presented only for the sake of illustration, which are not to be construed as limiting the scope of the present invention. It should be noted that in the following Examples and Comparative Examples, various properties were evaluated in the following manners.

Rope Length and Yarn Length in Inner Core

From a double rope structure (hereafter, may be simply referred to as a rope structure), a randomly selected section was cut to 1.000 m long to be regarded as rope length. The strands in the cut section were disassembled to take out the inner core. From the inner core, one strand was randomly selected and disassembled into yarns constituting the inner core, then lengths of all of the obtained yarns from the inner core were measured in taut state in accordance with JIS L1013, and the average of the lengths was regarded as yarn length.

Yarn Fineness (Dtex)

Strands constituting an inner core and strands constituting an outer cover of the rope structure were disassembled into yarns. The yarn fineness values of thus-obtained yarns from the inner core and the outer cover were measured in accordance with JIS L 1013.

Yarn Strength (N), Yarn Tenacity (cN/Dtex), Yarn Elongation (%), and Yarn Elastic Modulus (cN/Dtex)

Strands constituting an inner core of the rope structure were disassembled into yarns, and the yarn strength (N) of thus-obtained yarn was measured in accordance with JIS L 1013. In addition, the yarn elongation and the yarn elastic modulus were also measured. The yarn tenacity (cN/dtex) was calculated by dividing the yarn strength (cN) by the yarn fineness (dtex).

Pitch (Number of Yarns/Inch) and Lead (Mm/Yarn)

The number of yarns which exists in 1 inch in a rope was counted using a digital microscope VHX-2000 available from KEYENCE CORP to give a pitch. In addition, the lead, which was a length required for a strand a strand to make one complete helical convolution in the rope, was calculated by 25.4/(Pitch)
(Number of Strands).

Diameter

The diameters of a double rope structure and the inner core were measured using electronic slide caliper.

Crossing Angle

Using a digital microscope VHX-2000 available from KEYENCE CORP., a crossing angle of a strand in an inner core of the double rope structure was measured relative to the longitudinal direction in the rope.

Number of Yarn Twists

Untwisted yarns were measured using a measuring tape, and the number of twists in the untwisted yarns were determined.

Tensile Strength (kN) and Strength Utilization Degree (%) of Rope

Using a swirl type jig for rope evaluation (available from Chubu Machine Co., Ltd.) as a grip jig of a universal tester, a double rope structure was wound into a groove of the swirl part so that the rope was fixed by surface frictional resistance, the tensile strength of double rope structure was measured in accordance with JIS L 1013.

The strength utilization degree of the double rope structure was calculated as a ratio of tensile strength of the double rope structure based on a maximum strength obtained by (yarn tenacity of strands constituting the inner core)×(the number of all strands in the inner core) and expressed as a percentage.

Bending Durability: Tenacity Retention (%) after Bending

Using a bending test machine (TC111L/available from YUASA SYSTEM Co., Ltd.) employing a tensionless bending test jig (DX-TFB/available from YUASA SYSTEM Co., Ltd.), bending test was carried out in which a double rope structure was subjected to repeated bending of 300,000 times at a bending angle of 240° with a bending R of 7.5 mm so as to measure a tensile strength of the double rope structure before and after the bending test. The tenacity retention after bending was calculated as a ratio of the tensile strength of the double rope structure after the bending test relative to the tensile strength of the double rope structure before the bending test and expressed as a percentage.

Abrasion Resistance: Twisting Abrasion

Figure 5:
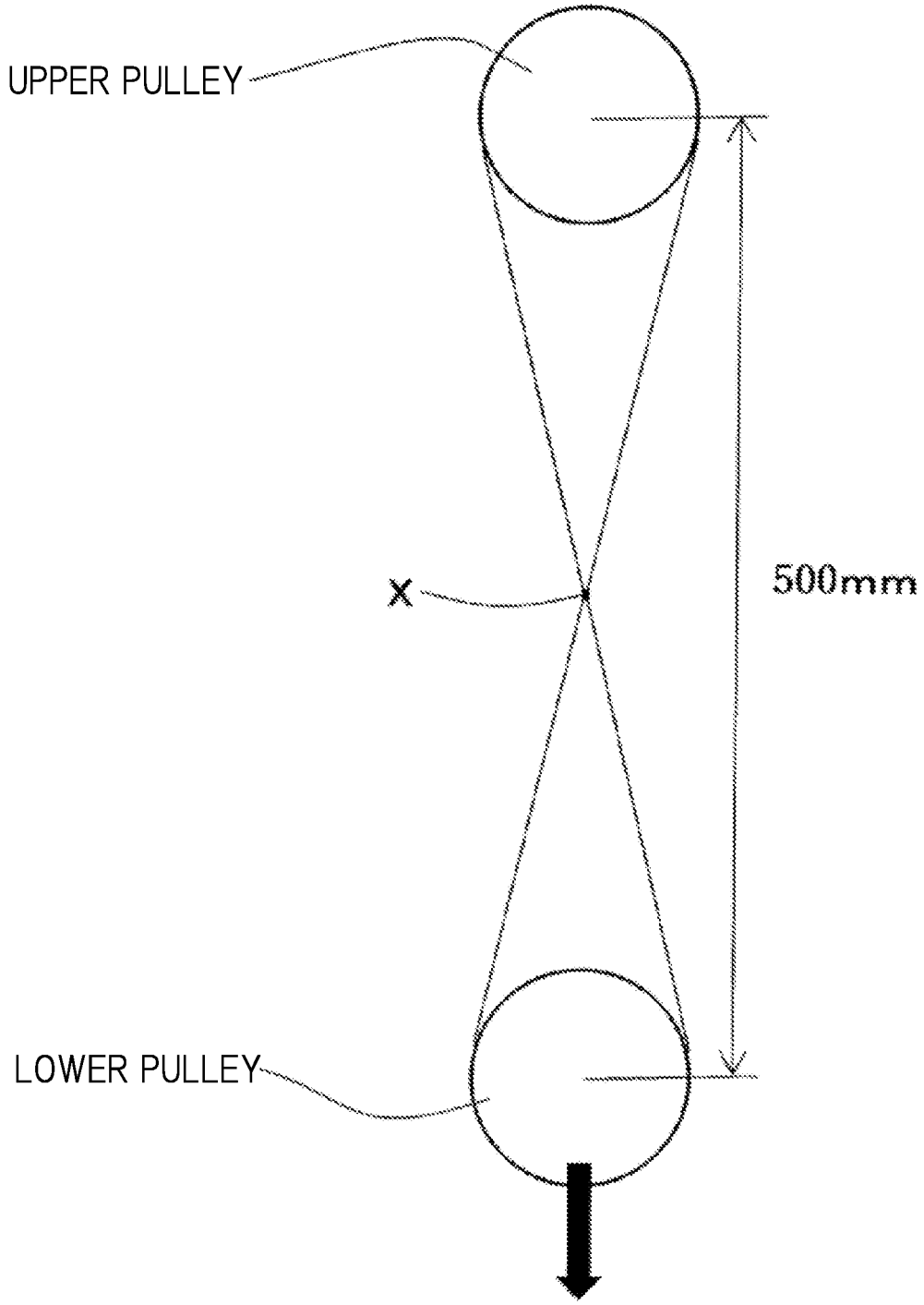
FIG. 5 is a schematic side view illustrating a twisting wear test.

As shown in FIG. 5, when the twisting abrasion test was carried out, a sample of a double rope structure was threaded through an upper pulley and a lower pulley and fixed so as not to slip on the pulleys. The inside diameter of both the upper pulley and the lower pulley was 45 mm. In the condition where the double rope structure was fixed, the distance between centers of the upper pulley and the lower pulley was adjusted to 500 mm.

The double rope structure was first formed in a loop shape, and then the double rope structure in a loop shape was twisted 3 times to form a twisted part X which was approximately 20 mm in length. Thereafter, the double rope structure was fixed to the upper pully and the lower pulley, and 3 kg of load was imposed to the lower pulley in the direction shown by a bottom arrow. The pulleys were made to reciprocate at an angle of 180° in a cycle of 60 times/minutes (MV=34.2 Hz) to abrade the twisted part of the double rope structure, and the number of pully-reciprocations was counted until the inner core of the double rope structure was broken with fracture. It should be noted that the upper limit of the number of pully-reciprocations was set to 1 million times.

Heat Resistance

After treating a double rope structure under a heated condition for 30 days at 80° C. in a thermo-hygrostat, the double rope structure was taken out from the thermo-hygrostat, and the tensile strength of the double rope structure was measured within 30 minutes in a test laboratory in the standard condition (temperature: 20±2° C., relative humidity of 65±2%). The heat resistance was calculated as a ratio of the tensile strength of the double rope structure after the heating test based on the tensile strength of the double rope structure before the heating test and expressed as a percentage.

Example 1

Liquid crystal polyester (LCP) multifilaments ("Vectran", fineness: 1760 dtex produced by KURARAY CO., LTD.) as high strength and high modulus fibers were braided using a braider (EL type, 12 strands as the number of carriers) manufactured by KOKUBUN LTD by adjusting the number of rotations and the taken-up speed of the braider so as to obtain an inner core rope having a pitch of 13 yarns/inch. Thus-obtained inner core rope was used as a core material, polyester multifilaments (fineness 280 dtex, yarn tenacity: 7.2 cN/dtex, yarn elastic modulus: 88 cN/dtex, yarn elongation: 15.1%, available from Toray Industries) were braided using a braider (middle type, 32 strands as the number of carriers) manufactured by KOKUBUN LTD by adjusting the number of rotations and the taken-up speed of the braider so as to obtain a double rope structure with an outer cover rope having a pitch of 46 yarns/inch.

Examples 2 to 4

Double rope structures were produced in the same manner as Example 1 except that pitches and ratios of lead/diameter of the inner cores of double rope structures were changed as shown in Table 5. The obtained results are shown in Table 5.

Example 5

A double rope structure was produced in the same manner as Example 1 except that ultra-high-molecular-weight-polyethylene (UHMWPE) multifilaments ("Isanas", fineness 1750 dtex, produced by Toyobo Co., Ltd.) were used as the high strength and high modulus fibers of the inner core of double rope structure. The obtained results are shown in Table 5.

Example 6

A double rope structure was produced in the same manner as Example 5 except that a pitch and a ratio of lead/diameter of the inner core of double rope structure was changed as shown in Table 5. The obtained results are shown in Table 5.

Example 7

A double rope structure was produced in the same manner as Example 1 except that p-aramid multifilaments ("Technora", fineness 1700 dtex, produced by Teijin Aramid B.V.) were used as the high strength and high modulus fibers of the inner core of double rope structure. The obtained results are shown in Table 5.

Example 8

A double rope structure was produced in the same manner as Example 7 except that a pitch and a ratio of lead/diameter of the inner core of double rope structure was changed as shown in Table 5. The obtained results are shown in Table 5.

Example 9

Liquid crystal polyester multifilaments ("Vectran", fineness: 1760 dtex produced by KURARAY CO., LTD.) as high strength and high modulus fibers were braided using a braider (large type, 8 strands in square shape as the number of carriers) manufactured by KOKUBUN LTD. by adjusting the number of rotations and the taken-up speed of the braider so as to obtain an inner core rope having a pitch of 9 yarns/inch. Thus-obtained inner core rope was used as a core material, polyester multifilaments (fineness 167 dtex, yarn tenacity: 7.2 cN/dtex, yarn elastic modulus: 88 cN/dtex, yarn elongation: 15.1%, available from Toray Industries) were braided using a braider (middle type, 32 strands as the number of carriers) manufactured by KOKUBUN LTD. by adjusting the number of rotations and the taken-up speed of the braider so as to obtain a double rope structure with an outer cover rope having a pitch of 46 yarns/inch.

Example 10

Liquid crystal polyester multifilaments ("Vectran", fineness: 5280 dtex produced by KURARAY CO., LTD.) as high strength and high modulus fibers were braided using a braider (EL type, 12 strands as the number of carriers) manufactured by KOKUBUN LTD. by adjusting the number of rotations and the taken-up speed of the braider so as to obtain an inner core rope having a pitch of 9 yarns/inch. Thus-obtained inner core rope was used as a core material, polyester multifilaments (fineness 244 dtex, yarn tenacity: 7.2 cN/dtex, yarn elastic modulus: 88 cN/dtex, yarn elongation: 15.1%, available from Toray Industries) were braided using a braider (middle type, 54 strands as the number of carriers) manufactured by KOKUBUN LTD. by adjusting the number of rotations and the taken-up speed of the braider so as to obtain a double rope structure with an outer cover rope having a pitch of 30 yarns/inch.

Comparative Examples 1 and 2

Double rope structures were produced in the same manner as Example 1 except that pitches and ratios of lead/diameter of the inner cores of double rope structures were changed as shown in Table 5. The obtained results are shown in Table 5.

Comparative Example 3

A double rope structure was produced in the same manner as Example 1 except that the number of twists and a pitch of the inner core of double rope structure was changed as shown in Table 5. The obtained results are shown in Table 5.

Comparative Example 4

A double rope structure was produced in the same manner as Example 2 except that polyester multifilaments (fineness 1748 dtex, yarn tenacity: 7.2 cN/dtex, yarn elastic modulus: 88 cN/dtex, yarn elongation: 15.1%, available from Toray Industries) were used for the inner core rope as the core material of the double rope structure. The obtained results are shown in Table 5.

TABLE 5

| | Items | Unit | Ex. 1 | Ex. 2 | Ex. 3 | Ex. 4 | Ex. 5 | Ex. 6 | Ex. 7 |
|---|---|---|---|---|---|---|---|---|---|
| Inner Core | Fiber Species | | LCP | LCP | LCP | LCP | UHMW PE | UHMW PE | p-aramid |
| | Yarn Fineness | dtex | 1760 | 1760 | 1760 | 1760 | 1750 | 1750 | 1700 |
| | Yarn Strength | N | 430 | 430 | 430 | 430 | 415 | 415 | 387 |
| | Yarn Tenacity | cN/dtex | 24.4 | 24.4 | 24.4 | 24.4 | 23.7 | 23.7 | 22.8 |
| | Yarn Elastic Modulus | cN/dtex | 465 | 465 | 465 | 465 | 496 | 496 | 476 |
| | Yarn Elongation | % | 4.4 | 4.4 | 4.4 | 4.4 | 5.0 | 5.0 | 5.4 |
| | Structure (Number of Strands, Shape) | | 12, Round | 12, Round | 12, Round | 12, Round | 12, Round | 12, Round | 12, Round |
| | Pitch | yarns/inch | 12.6 | 9.1 | 5.3 | 3.4 | 11.4 | 4.7 | 12.2 |
| | Lead | mm/yan | 24.2 | 33.5 | 57.5 | 89.6 | 26.7 | 64.9 | 25.0 |
| | Lead/Diameter | /yarn | 11.9 | 17.0 | 32.3 | 48.7 | 11.3 | 32.1 | 12.4 |
| | Crossing Angle | ° | 27 | 20 | 13 | 10 | 31 | 14 | 25 |
| | Yarn Length/Rope Length | | 1.081 | 1.041 | 1.015 | 1.007 | 1.104 | 1.010 | 1.074 |
| | Number of Yarn Twists | T/m | 55 | 35 | 22 | 15 | 58 | 15 | 60 |
| | Diameter | mm | 2.0 | 2,0 | 1.8 | 1.8 | 2.4 | 2.0 | 2.0 |
| Outer Cover | Fiber Species | | PET | PET | PET | PET | PET | PET | PET |
| | Yarn Fineness | dtex | 280 | 280 | 280 | 280 | 280 | 280 | 280 |
| | Structure (Number of Strands, Shape) | | 32, Round | 32, Round | 32, Round | 32, Round | 32, Round | 32, Round | 32, Round |
| | Pitch | yarns/inch | 44.8 | 46.7 | 44.2 | 45.3 | 44.7 | 43.7 | 44.6 |
| Rope | Diameter | mm | 2.2 | 2.2 | 2.0 | 2.0 | 2.6 | 2.2 | 2.2 |
| | Inner Core Percentage | wt % | 67 | 66 | 66 | 66 | 68 | 65 | 66 |
| Eval-uation | Tensile Strength | kN | 3.0 | 3.5 | 4.1 | 4.2 | 3.2 | 4.5 | 3.4 |
| | Strength Utilization Degree | % | 57 | 67 | 80 | 81 | 65 | 91 | 73 |
| | Tenacity Retention After Bending | % | 100 | 98 | 65 | 55 | 87 | 80 | 99 |
| | Twisting Abrasion | ×10000 times | ≥100 | ≥100 | ≥100 | ≥100 | 69 | 62 | 13 |
| | Heat Resistance | % | 95 | 95 | 95 | 95 | 40 | 40 | 96 |

| | Items | Unit | Ex. 8 | Ex. 9 | Ex. 10 | Com. Ex. 1 | Com. Ex. 2 | Com. Ex. 3 | Com. Ex. 4 |
|---|---|---|---|---|---|---|---|---|---|
| Inner Core | Fiber Species | | p-aramid | LCP | LCP | LCP | LCP | LCP | PET |
| | Yarn Fineness | dtex | 1700 | 1760 | 5280 | 1760 | 1760 | 1846 | 1748 |
| | Yarn Strength | N | 387 | 430 | 1290 | 430 | 430 | 211 | 126 |
| | Yarn Tenacity | cN/dtex | 22.8 | 24.4 | 24.4 | 24.4 | 24.4 | 11.4 | 7.2 |
| | Yarn Elastic Modulus | cN/dtex | 476 | 465 | 465 | 465 | 465 | 87 | 88 |
| | Yarn Elongation | % | 5.4 | 4.4 | 4.4 | 4.4 | 4.4 | 5.4 | 15.1 |
| | Structure (Number of Strands, Shape) | | 12, Round | 8, Square | 12, Round | 12, Round | 12, Round | 12, Round | 12, Round |
| | Pitch | yarns/inch | 3.6 | 8.7 | 8.7 | 21.5 | 0 | 9 | 9.6 |
| | Lead | mm/yan | 84.7 | 23.2 | 35.0 | 14.2 | 0.0 | 33.9 | 31.7 |
| | Lead/Diameter | /yarn | 49.8 | 15.9 | 10.9 | 6.6 | 0.0 | 16.1 | 17.1 |
| | Crossing Angle | ° | 9 | 16 | 28 | 43 | 0 | 14 | 1 |
| | Yarn Length/Rope Length | | 1.006 | 1.044 | 1.122 | 1.252 | 1.004 | 1.087 | 1.044 |
| | Number of Yarn Twists | T/m | 22 | 48 | 33 | 107 | 0 | 205 | 33 |
| | Diameter | mm | 1.7 | 1.5 | 3.2 | 2.2 | 1.6 | 2.1 | 1.9 |
| Outer Cover | Fiber Species | | PET | PET | PET | PET | PET | PET | PET |
| | Yarn Fineness | dtex | 280 | 167 | 244 | 280 | 280 | 280 | 280 |
| | Structure (Number of Strands, Shape) | | 32, Round | 32, Round | 54, Round | 32, Round | 32, Round | 32, Round | 32, Round |
| | Pitch | yarns/inch | 44.7 | 56 | 25.5 | 46.4 | 44.9 | 54.6 | 54.2 |
| Rope | Diameter | mm | 1.9 | 1.7 | 3.4 | 2.4 | 1.8 | 2.2 | 2.0 |
| | Inner Core Percentage | wt % | 65 | 66 | 85 | 70 | 66 | 65 | 64 |
| Eval-uation | Tensile Strength | kN | 3.9 | 2.5 | 6.7 | 2.0 | 4.7 | 2.0 | 1.6 |
| | Strength Utilization Degree | % | 84 | 73 | 43 | 38 | 91 | 79 | 106 |
| | Tenacity Retention After Bending | % | 77 | 65 | 92 | 95 | 43 | 100 | 100 |
| | Twisting Abrasion | ×10000 times | 11 | 59 | ≥100 | ≥100 | 55 | 57 | 49.5 |
| | Heat Resistance | % | 96 | 95 | 95 | — | — | — | — |

As shown in Table 5, in Comparative Example 1, since the ratio of yarn length/rope length is too large, although the inner core of the double rope structure is formed from the high strength and high modulus fibers, the double rope structure cannot effectively use the tenacity of high strength and high modulus fibers, resulting in deterioration in the tensile strength and the strength utilization degree of the double rope structure.

In Comparative Example 2, since the ratio of yarn length/rope length is small, the double rope structure cannot satisfactorily maintain the tenacity retention after bending.

In Comparative Example 3, since the double rope structure cannot effectively utilize the tenacity of the highly twisted high strength and high modulus fibers, even if the used fiber species and the number of pitches are proper, the double rope structure cannot show satisfactory tensile strength.

In Comparative Example 4, since the yarn tenacity and the yarn elastic modulus are too small, the double rope structure cannot show satisfactory tensile strength.

On the other hand, all of the double rope structures of Examples 1 to 10 can show higher values of tensile strength as well as strength utilization degree than those in Comparative Example 1, and can show higher values of tenacity retention after bending than those in Comparative Example 2. In particular, the double rope structure of Examples 1 to 6 and 9 to 10 are excellent in twisting abrasion, and the double rope structure of Examples 1 to 4 and 7 to 10 are excellent in heat resistance.

INDUSTRIAL APPLICABILITY

The double rope structure according to the present invention can be advantageously used in the fields such as applications in water for mooring ropes for vessels and fishing nets, ropes for mooring floating waterborne facilities on the surface of water and floating marine structures used for exploration of marine resources and others to the ocean floor; applications on land such as traction ropes and load ropes, as well as ropes for wind power station and transforming equipment; and further applications for sports and leisure, and others.

As mentioned above, the preferred embodiments of the present invention are illustrated with reference to the drawings, but it is to be understood that other embodiments may be included, and that various additions, other changes or deletions may be made in the light of the specification, without departing from the spirit or scope of the present invention.

What is claimed is:

1. A double rope structure, comprising an inner core and an outer cover, wherein the inner core comprises a plurality of yarns, each yarn comprising a plurality of high strength and high modulus single fibers and having a yarn tenacity of 20 cN/dtex or higher and a yarn elastic modulus of 400 cN/dtex or higher, and the inner core has a ratio of yarn length/rope length of 1.005 or more and 1.200 or less, the rope length being determined as a length of a cut section cut to a certain length from the rope structure, and the yarn length being determined as an average value of lengths of the yarns constituting the inner core of the cut section.

2. The double rope structure according to claim 1, wherein the inner core comprises a plurality of strands, each strand containing the plurality of yarns, and the strands which constitute the inner core have a crossing angle of 40° or less relative to a longitudinal direction of the rope structure.

3. The double rope structure according to claim 2, wherein a number of twists of each yarn in the inner core is from 150 to 0.1 T/m.

4. The double rope structure according to claim 1, wherein the yarns in the inner core have a yarn elongation of from 3 to 6%.

5. The double rope structure according to claim 1, wherein the high strength and high modulus single fibers are at least one selected from the group consisting of liquid crystal polyester fibers, ultra-high molecular weight polyethylene fibers, aramid fibers, and poly(para-phenylene benzobisoxazole) fibers.

6. The double rope structure according to claim 1, wherein the inner core comprises a plurality of strands, each strand containing the plurality of yarns, and the double rope structure satisfies a strength utilization degree of 40% or more, the strength utilization degree being a percentage of tensile strength of the double rope structure based on a value obtained by multiplying a tenacity of the strands constituting the inner core by a number of all strands in the inner core.

7. The double rope structure according to claim 1, wherein the double rope structure has a tenacity retention of 45% or more comparing before and after bending test, in which the double rope structure is subjected to repeated bending of 300,000 times at a bending angle of 240° with a bending R of 7.5 mm.

8. The double rope structure according to claim 1, wherein the double rope structure has a tenacity retention of 45% or more at a temperature of 80° C.

9. The double rope structure according to claim 1, wherein the inner core accounts for 40 wt % or more of the double rope structure.

10. A double rope structure, comprising an inner core and an outer cover, wherein the inner core comprises a plurality of yarns, each yarn comprising a plurality of high strength and high modulus single fibers and having a yarn tenacity of 20 cN/dtex or higher and a yarn elastic modulus of 400 cN/dtex or higher, the inner core has a ratio of yarn length/rope length of 1.005 or more and 1.200 or less, the rope length being determined as a length of a cut section cut to a certain length from the rope structure, and the yarn length being determined as an average value of lengths of the yarns constituting the inner core of the cut section, and the outer cover comprises 80 wt % or more of non-high strength and non-high modulus fibers.

11. A double rope structure, comprising an inner core and an outer cover, wherein the inner core comprises a plurality of yarns, each yarn comprising a plurality of high strength and high modulus single fibers and having a yarn tenacity of 20 cN/dtex or higher and a yarn elastic modulus of 400 cN/dtex or higher, the inner core has a ratio of yarn length/rope length of 1.005 or more and 1.200 or less, the rope length being determined as a length of a cut section cut to a certain length from the rope structure, and the yarn length being determined as an average value of lengths of the yarns constituting the inner core of the cut section, and both the inner core and the outer cover are braided bodies.

* * * * *